US005254273A

United States Patent [19]

Kageyama et al.

[11] Patent Number: 5,254,273

[45] Date of Patent: Oct. 19, 1993

[54] GREASE COMPOSITION

[75] Inventors: Hachiro Kageyama, Kamakura; Shoji Yamanaka, Hiroshima; Shigeo Tamai, Yokohama, all of Japan

[73] Assignee: Kyodo Yushi Co., Ltd., Tokyo, Japan

[21] Appl. No.: 956,962

[22] Filed: Oct. 6, 1992

Related U.S. Application Data

[63] Continuation-in-part of Ser. No. 740,179, Aug. 5, 1991, abandoned.

[30] Foreign Application Priority Data

Aug. 6, 1990 [JP] Japan ..... 2-206703
Jul. 10, 1991 [JP] Japan ..... 3-195058

[51] Int. Cl.[5] ..... C10M 115/08; C10M 113/00

[52] U.S. Cl. ..... 252/34; 252/18; 252/25; 252/32.7 R

[58] Field of Search ..... 252/18, 32.7 R, 34

[56] References Cited

U.S. PATENT DOCUMENTS

| | | | |
|---|---|---|---|
| 3,344,065 | 9/1967 | Gansheimer et al. | 252/18 |
| 3,370,007 | 2/1968 | Caruso | 252/28 |
| 3,763,043 | 10/1973 | Thompson | 252/31 |
| 3,853,773 | 12/1974 | Martin et al. | 252/32.7 E |
| 4,049,879 | 9/1977 | Thompson et al. | 429/191 |
| 4,130,492 | 12/1978 | Longo et al. | 252/18 |
| 4,267,157 | 5/1981 | Maas, Jr. et al. | 423/303 |
| 4,767,551 | 8/1988 | Hunt et al. | 252/32.7 E |

*Primary Examiner*—Ellen M. McAvoy
*Attorney, Agent, or Firm*—Young & Thompson

[57] ABSTRACT

A grease composition comprises a base oil and a particular amount of at least one intercalation compound consisting of a metal phosphorus chalcogenide as a host and an alkylamine or alkylammonium chloride as a guest, and has excellent extreme pressure property and wear resistance.

9 Claims, 1 Drawing Sheet

GREASE COMPOSITION

This application is a continuation-in-part of the copending application Ser. No. 740,179 filed Aug. 5, 1991, now abandoned.

BACKGROUND OF THE INVENTION

Field of the Invention

This invention relates to an extreme pressure grease composition comprising a crystal powder of a metallic phosphorus chalcogenide having a layered structure as a host layer and an intercalation compound of an alkylamine or an alkylammonium chloride as a guest, which are dispersed into a base oil to thicken in form of a semi-solid.

Description of the Related Art

A lubricating grease is a semi-solid or solid lubricant, which is a substance having such physical and chemical properties that it exists between two solid surfaces of relative movement to reduce friction and wear on the solid surface, decrease dynamic loss and prevent seizuring, fatigue failure and the like. In ASTM Glossary, a lubricating grease is defined as a semi-solid product obtained by dispersing a thickener into a lubricating oil and, if necessary, containing other components for imparting specific properties.

In a lubricating grease, therefore, the base oil and the thickener are essential, and also an extreme pressure additive, a rust-preventing agent, an antioxidant, a tackifier, a solid lubricant and the like may be added in accordance with use purpose, whereby various greases are produced.

As the base oil for the lubricating grease, there are used a petroleum lubricating oil as well as synthetic lubricating oils such as synthetic ester oil, $\alpha$-olefin oil, phenyl ether oil and the like. As the thickener, there are used a metallic soap and its complex soaps, urea derivatives, organophilic bentonite, amorphous silica and the like.

The lubricating greases are used under various lubricating conditions over a very wide industrial field. For instance, they are used in bearings for hot rolling mills in a steel-making factory, which are operated at a high temperature under a high load and a great amount of water is incorporated, in automobiles and railroad vehicles requiring high service life, bearings for small-size motors guaranteeing stable rotation under a light load over wide temperature range, and the like. In the planning of a grease most suitable for these applications, the performances required for the grease are secured by compounding the above various additives with a combination of the lubricating oil and the thickener under the existing circumstances.

On the other hand, it is favorable to reduce the number of components constituting the lubricating grease as far as possible from viewpoints of the simplification of production steps and material maintenance and the reduction of cost. For this end, the use of multi-purpose component has hitherto been considered, and consequently it has been suggested to use an extreme pressure lubricating oil such as phosphate ester oil or the like and an extreme pressure thickener such as chlorinated fatty acid metallic soap or the like. The former has drawbacks in that a rubbery material such as packing or the like is swollen and the rust-preventing property is lowered due to the incorporation of water, while the latter is poor in the thickening ability, so that to date they are not widely utilized.

As an example of using a crystal powder having a layered structure in the lubricating grease, graphite, molybdenum disulfide and the like have previously been widely used as a solid lubricant. However, these crystal powders of the layered structure have no effect of thickening the lubricating oil, and even if the powder is mixed with the lubricating oil, there occurs a rapid separation between the powder and the lubricating oil, so that it is impossible to obtain a grease-like mixture. Therefore, only the lubricating action of the powder is utilized by adding the powder to a grease containing a thickener.

As an example of powder of the layered structure capable of thickening the lubricating oil, there is known an organophilic bentonite obtained by reacting an alkylammonium chloride between layers of bentonite. In this case, the lubricating action is developed by the slipping between the layers, but there can not be expected in such an extreme pressure action as conducted in sulfur series extreme pressure additive or sulfur-phosphorus series extreme pressure additive that sulfur reacts with local friction portion to produce an iron sulfide film having a melting point of about 1000° C. for the prevention of metal contact, or a low melting-point eutectic body of iron phosphide and iron is produced to give an action smoothening the friction surface.

SUMMARY OF THE INVENTION

It is, therefore, an object of the invention to provide a lubricating grease composition using an intercalation compound developing a thickening action in the mixing with a lubricating oil and having excellent extreme pressure property, anti-seizuring function and wear resistance.

It has been known that the metallic phosphorus chalcogenide is a crystal powder of a layered structure containing phosphorus (P) and a chalcogen element such as sulfur (S), selenium (Se), tellurium (Te) or the like in its molecule and further including a metallic element such as Zn, Mg, Pb or the like, and is also a solid lubricant having improved extreme pressure property and anti-siezuring action (U.S. Pat. No. 4,130,492). However, this powder has no action of thickening the lubricating oil.

Furthermore, it is well-known that an inter-calation compound between a sulfide of Group IVa or Va metal and an amine such as pyridine or the like is used as a solid lubricant (U.S. Pat. No. 3,763,043). Such an intercalation compound contains sulfur (S), but does not contain phosphorus (P) playing a great part for extreme pressure lubrication together with sulfur.

Moreover, various guests can be intercalated between layers of the above metallic phosphorus chalcogenide to form intercalation compounds. In this connection, the inventors have studied the intercalation compound and made various experiments using various guests and have discovered that when alkylamine or alkylammonium chloride is used as a guest, crystal powder of the resulting intercalation compound has excellent extreme pressure property and anti-seizuring action and develops the thickening action when such a crystal power is dispersed into a lubricating oil.

That is, multi-purpose substances acting as a solid lubricant having an excellent extreme pressure property and as a thickener are obtained from the above intercalation compounds, whereby the invention has been accomplished.

According to the invention, there is the provision of a grease composition comprising a base oil and 1-70% by weight of at least one intercalation compound consisting of a metallic phosphorus chalcogenide as a host layer and an alkylamine or alkylammonium chloride as a guest.

The grease composition thickened with the intercalation compound of the layered structure according to the invention develops an improved extreme pressure property without adding an extreme pressure additive.

When the amount of the intercalation compound is less than 1% by weight, the thickening effect is not obtained, while when it exceeds 70% by weight, the wettability to the base oil is lost and the resulting product becomes dry and crumbles and the homogeneous grease can not be obtained.

DESCRIPTION OF THE PREFERRED EMBODIMENTS

The metallic phosphorus chalcogenide used in the invention is a compound having a molecular formula (1) of $MPX_3$ (wherein M is a metallic element selected from Zn, Mg, Ca, V, Mn, Fe, Co, Ni, Pb, Dc, Hg, Sn and Nb and X is a chalcogen element selected from S, Se and Te) and can be produced by reacting a metal, phosphorus and a chalcogen element, or a metal sulfide, phosphorus and a chalcogen element under heating according to the well-known method.

As the metallic phosphorus chalcogenide, mention may be made of $ZnPS_3$, $ZnPSe_3$, $ZnPTe_3$, $NiPS_3$, $FePS_3$, $FePSe_3$, $MnPS_3$, $MnPS_3$, $MgPSe_3$, $CaPS_3$, $CaPSe_3$ and the like. All of these chalcogenides have a layered crystal structure and form intercalation compounds through the intercalation of the guest.

The alkylamine used as a guest in the intercalation compound according to the invention is a compound having the following molecular formula (2);

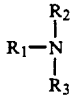

(2)

(wherein each of $R_1$, $R_2$ and $R_3$is a hydrogen atom or a straight or branched chain alkyl group having a carbon number of 1-24). Concretely, it includes n-butylamine, octylamine, 2-octylamine, dodecylamine, hexadecylamine, octadecylamine, oleylamine, N-methyl octadecylamine, N,N-dimethyl octadecylamine and the like.

Further, the alkylammonium chloride used as a guest in the intercalation compound according to the invention is a compound having the following molecular formula (3):

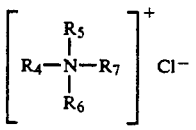

(3)

(wherein two of $R_4$, $R_5$, $R_6$ and $R_7$ are methyl group or a straight or branched chain alkyl group having a carbon number of 4-24, respectively, and the remaining two are methyl group, respectively). Concretely, it includes trimethylhexadecyl ammonium chloride, trimethyloctadecyl ammonium chloride, dimethyldioctadecyl ammonium chloride and the like.

The intercalation compound used in the invention is obtained by contacting and reacting the compound of the formula (1) with the compound of the formula (2) or (3), so that it is not particularly required to specify the production method. For instance, there are a vapor phase reaction method in which the compound of the formula (2) or (3) vaporized by heating under a reduced pressure is contacted with the compound of the formula (1), a mixing method in which both the compound of the formula (1) and the compound of the formula (2) or (3) are directly mixed with stirring and, if necessary, heated, a pressurization method in which these compounds are mixed and then pressurized and, if necessary, heated, a solvation method in which the compound of the formula (2) or (3) is dissolved in an organic solvent and contacted with the compound of the formula (1), and the like. Furthermore, the intercalation compound according to the invention can be produced by intercalating an aklylamine having a small molecular weight such as n-butylamine or the like into the compound of the formula (1) and then adding a solution of an aklylamine having a large molecular weight or an alkylammonium chloride in a suitable solvent thereto.

Although all of these methods can be adopted, when the amine or ammonium compound being easily modified and hardly vaporized by heating is used as guest, if it is intended to prevent the bad influence of solvent through adsorption, it is desirable to conduct the mixing method or the pressurization method without heating. Moreover, the amount of the compound of the formula (2) or (3) to be reacted with the compound of the formula (1) is within a range of about 0.1-5 mol.

The intercalation compound according to the invention has a layered structure in which thin crystal layers are repeatedly laminated one upon the other as previously mentioned. Particularly, the guest compound of the formula (2) or (3) containing an alkyl group and a polar group or ion group and having excellent lubricity and reactivity is intercalated between host layers of the compound of the formula (1) and strongly bonded to the host layer to widen the basal spacing, whereby the host layers in the intercalation compound easily slip with each other.

Therefore, the intercalation compound according to the invention is excellent in the lubricating action through the slipping between the host layers. Furthermore, the metallic phosphorus chalcogenide used as a host layer contains a greater amount of a combination of phosphorus with sulfur, selenium or tellurium developing an effect known as an extreme pressure agent and also contains zinc (Zn), lead (Pb), tin (Sn), magnesium (Mg) or calcium (Ca) having a good lubricity as a metal, so that it is excellent in the properties under extreme pressure. Moreover, the intercalation compound according to the invention in which the amine or the like having an alkyl group is intercalated between the host layers is an improved extreme pressure lubricant as it is. Therefore, the intercalation compound according to the invention possesses excellent extreme pressure lubricity and sliding friction property and can be said to be a most ideal lubricant. According to the inventors' studies, it could be found that the intercalation compound according to the invention is excellent in the effect of thickening the lubricating oil. That is, the grease composition containing the intercalation compound according to the invention serves as an extreme pressure grease without adding an extreme pressure additive because the intercalation compound as a thickener acts as an extreme pressure additive different from the conventional extreme pressure greases.

As the base oil in the grease composition according to the invention, use may be made of petroleum lubricating oil and various synthetic lubricating oils. As the synthetic lubricating oil, use may be made of ester between dibasic acid and higher alcohol such as dioctyl sebacate (DOS), dioctyl adipate (DOA) or the like; neopentyl polyol ester; phosphate ester; polyphenyl ether, poly α-olefins having various viscosities; polyglycols; silicone oil and the like.

Figure 1:
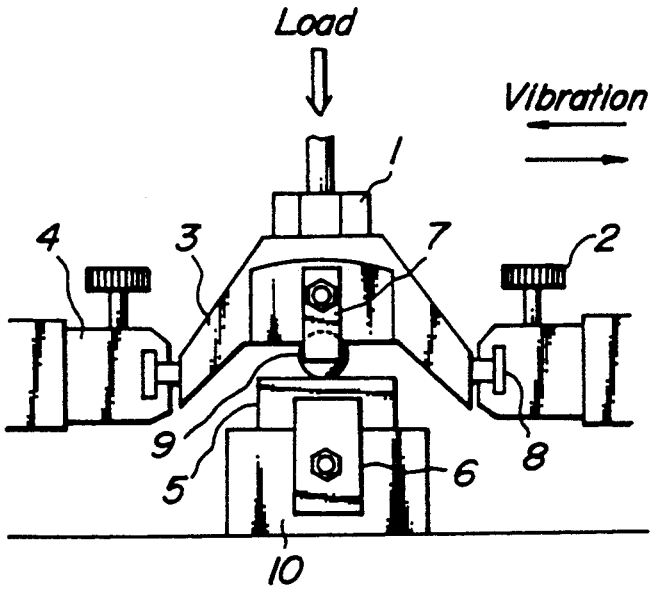
FIG. 1 is a schematic front view of a vibration friction testing machine for the measurement of friction coefficient in the grease composition.

The following examples are given in illustration of the invention and are not intended as limitations thereof.

Moreover, the metallic phosphorus chalcogenide used in the invention was produced according to the conventionally known method (U.S. Pat. No. 4,130,492).

I. Preparations of intercalation compound and grease

Intercalation compounds and grease samples shown in Tables 1 and 2 were prepared as follows.

EXAMPLES 1 and 2

$AnPS_3$ and n-butylamine were mixed at a mol ratio of 1:1–2.5 and uniformly ground in a mortar to prepare an intercalation compound. Then, 10% by weight or 30% by weight of the intercalation compound was mixed with a petroleum lubricating oil (ISO-VG 450) and well kneaded with acetone as a dispersant in three-roll mill to obtain a grease sample.

EXAMPLES 3 and 4

$ZnPS_3$ and octylamine were mixed at a mol ratio of 1:1–1.5 and uniformly ground in a mortar to prepare an intercalation compound. Then, a grease sample was prepared by using the intercalation compound in the same manner as in Example 1.

EXAMPLES 5 and 6

Hydrogenated tallow amine (consisting essentially of octadecylamine) was dissolved in ethyl alcohol in an amount corresponding to a mol ratio of $ZnPS_3$ to octadecylamine of 1:0.2–1 and mixed with the same intercalation compound as in Example 1. The resulting mixture was left to stand over a night, filtered, washed, dried and uniformly ground in a mortar to prepare an intercalation compound. Then, a grease sample was prepared by using this intercalation compound in the same manner as in Example 1.

EXAMPLES 7 and 8

N,N-diemthyldioctadecyl ammonium chloride was dissolved in isopropyl alcohol in an amount corresponding to a mol ratio to $ZnPS_3$ of 1:0.2–1 and mixed with the same intercalation compound as in Example 1. The resulting mixture was left to stand over a night, filtered, washed, dried and uniformly ground in a mortar to prepare an intercalation compound. Then, a grease sample was prepared by using this intercalation compound in the same manner as in Example 1.

EXAMPLES 9 and 10

$MgPS_3$ and octylamine were mixed at a mol ratio of 1:1–1.5 and uniformly ground in a mortar to prepare an intercalation compound. Then, a grease sample was prepared by using the intercalation compound in the same manner as in Example 1.

EXAMPLE 11

$CaPS_3$ and octylamine were mixed at a mol ratio of 1:1–1.5 and uniformly ground in a mortar to prepare an intercalation compound. Then, a grease sample was prepared by using 20% by weight of the intercalation compound in the same manner as in Example 1.

EXAMPLE 12

$Zn_{0.7}Ca_{0.3}PS_3$ and octylamine were mixed at a mol ratio of 1:1–1.5 and uniformly ground in a mortar to prepare an intercalation compound. Then, a grease sample was prepared by using the intercalation compound in the same manner as in Example 1.

EXAMPLE 13

A grease sample was prepared by mixing 15% by weight of the same intercalation compound as in Example 3 and 15% by weight of the same intercalation compound as in Example 7 with a petroleum lubricating oil (ISO-VG 450) and treating in the same manner as in Example 1.

EXAMPLE 14

A grease sample was prepared by mixing 15% by weight of the same intercalation compound as in Example 5 and 15% by weight of the same intercalation compound as in Example 7 with a petroleum lubricating oil (ISO-VG 450) and treating in the same manner as in Example 1.

EXAMPLE 15

A grease sample was prepared by mixing 15% by weight of the same intercalation compound as in Example 5 and 15% by weight of the same intercalation compound as in Example 9 with a petroleum lubricating oil (ISO-VG 450) and treating in the same manner as in Example 1.

EXAMPLES 16, 17 and 18

The same intercalation compound as in Example 3 was mixed in an amount of 20% by weight with DOS, poly-olefin oil or alkyldiphenyl ether oil widely used as a synthetic lubricating oil and added with acetone as a dispersant and kneaded in three-roll mill to prepare a grease sample.

EXAMPLES 19, 20 and 21

The same intercalation compound as in Example 5 was mixed in an amount of 20% by weight with DOS, poly α-olefin oil or alkyldiphenyl ether oil widely used as a synthetic lubricating oil and added with acetone as a dispersant and kneaded in three-roll mill to prepare a grease sample.

II. Tests for extreme pressure property and wear resistance

II.1 Test for extreme pressure property

The seizuring load was measured with respect to each grease sample by a Falex method defined according to ASTM D2625B.

II.2 Test for wear resistance

The kinetic friction coefficient of each grease sample and the worn depth of test specimen were measured by means of an SRV oscillating friction and wear testing machine (made by Optimal AG in Germany).

This testing machine can reproduce the friction state under conditions of a combination of metals and/or synthetic resins (metal/metal, metal/synthetic resin, synthetic resin/synthetic resin) and presence or absence of lubricant through vibration slipping motion under a high load.

A main part of this machine is shown in FIG. 1. A fixed support 10 is connected to a fixed holder 3 for a test specimen being a movable interchange holder through upper and lower specimens (5, 9). These support and holder are pressed by means of an electronic control loading device. Oscillations produced from a moving-coil are transferred to the fixed holder 3. Various friction tests of point contact, face contact, line contact and the like can be conducted by properly selecting the test specimen 9.

In this example, the point contact test was conducted. The result can be evaluated by using a disc as the test specimen 5 and a ball as the test specimen 9. Thus, a steel disc of 24 mm (diameter)×7.85 mm was used as the test specimen 5 on the support 10, and a steel ball of 10 mm in diameter was used as the test specimen 9 on the holder 3.

In FIG. 1, numeral 1 is a nut for fixation (against the holder provided with screw threads), numeral 2 a fixing screw, numeral 4 a vibration stroke cylinder provided with a fixing chuck (female), numeral 6 a pushing member on the front face of the test specimen 5, numeral 7 a pushing member on the test specimen 9 (ball), and numeral 8 a chuck (male) for the fixed holder.

The operating conditions of the testing machine were set as follows:

| | |
|---|---|
| Load | 200N |
| Amplitude | 1.0 mm |
| Frequency | 50 Hz |
| Running time | 30 minutes |

Under these conditions, the test was carried out by interposing each grease sample of Examples and Comparative Examples between both the test specimens, during which the kinetic friction coefficient was measured by means of a recorder. After the test, the worn depth produced on the surface of the disc was measured by means of a roughness meter. In this way, the wear resistance of every grease sample was evaluated.

The measured results are shown in Tables 1 and 2.

TABLE 1

| host | guest | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Intercalation compound | | | | | | | | | | | |
| $ZnPS_3$ | n-butyl-amine | 10% | 30% | | | | | | | | |
| $ZnPS_3$ | octylamine | | | 10% | 30% | | | | | | |
| $ZnPS_3$ | octadecyl-amine | | | | | 10% | 30% | | | | |
| $ZnPS_3$ | N,N-diocta-decyldi-methyl ammonium chloride | | | | | | | 10% | 30% | | |
| $MgPS_3$ | octylamine | | | | | | | | | 10% | 30% |
| $CaPS_3$ | octylamine | | | | | | | | | | |
| $Zn_{0.7}Ca_{0.3}PS_3$ | octylamine | | | | | | | | | | |
| Base oil | | | | | | | | | | | |
| petroleum lubricating oil (ISO-VG 450) | | 89% | 67% | 89% | 67% | 89% | 67% | 89% | 67% | 89% | 67% |
| Dispersant | | | | | | | | | | | |
| acetone | | 1% | 3% | 1% | 3% | 1% | 3% | 1% | 3% | 1% | 3% |
| Properties | | | | | | | | | | | |
| appearance | | grayish white grease | grayish white grease | grayish white grease | grayish white grease | grayish white grease | grayish white grease | grayish white grease | grayish white grease | grayish white grease | grayish white grease |
| consistency (25° C.) | 0 W | 440 | 321 | 439 | 257 | 338 | 238 | 434 | 256 | 405 | 325 |
| | 60 W | 440 | 327 | 420 | 265 | 334 | 239 | 434 | 258 | 400 | 327 |
| dropping point °C. | | 153 | 160 | 154 | 190 | 213 | 217 | 217 | 200 | 170 | 177 |
| Lubricity | | | | | | | | | | | |
| Extreme pressure test (Falex method) (according to ASTM D2625B) Seizuring load (pound) | | 2000 | 2000 | 1750 | 1750 | 2000 | 2000 | 2000 | 2000 | 1750 | 2000 |
| SRV oscilla-ting friction and wear test | friction coefficient | 0.093 | 0.092 | 0.100 | 0.090 | 0.095 | 0.090 | 0.097 | 0.093 | 0.095 | 0.090 |
| | worn depth μm | 0.4 | 0.3 | 0.2 | 0.2 | 0.2 | 0.2 | 0.2 | 0.4 | 0.3 | 0.3 |

| host | guest | Example 11 | Example 12 | Example 13 | Example 14 | Example 15 | Comparative Example 1 | Comparative Example 2 | Comparative Example 3 | Comparative Example 4 | Comparative Example 5 |
|---|---|---|---|---|---|---|---|---|---|---|---|
| Intercalation compound | | | | | | | | | | | |
| $ZnPS_3$ | n-butyl-amine | | | | | | 100% benton- | 100% lithium | 97% lithium | 97% lithium | 10% $ZnPS_3$ |

TABLE 1-continued

| | | | | | | | | | | | |
|---|---|---|---|---|---|---|---|---|---|---|---|
| $ZnPS_3$ | octylamine | | | 15% | | | ite-base | soap-base | soap-base | soap-base | |
| $ZnPS_3$ | octadecyl-amine | | | | 15% | 15% | grease of No. 1 grade | grease of No. 1 grade | grease of No. 1 grade + 3% molybdenum disulfide | grease of No. 1 grade + 3% graphite | |
| $ZnPS_3$ | N,N-diocta-decyldi-methyl ammonium chloride | | | 15% | 15% | | | | | | |
| $MgPS_3$ | octylamine | | | | | 15% | | | | | |
| $CaPS_3$ | octylamine | 20% | | | | | | | | | |
| $Zn_{0.7}Ca_{0.3}PS_3$ | octylamine | | 20% | | | | | | | | |
| Base oil | | | | | | | | | | | |
| petroleum lubricating oil (ISO-VG 450) | | 78% | 78% | 67% | 67% | 67% | | | | | 89% |
| Dispersant | | | | | | | | | | | |
| acetone | | 2% | 2% | 3% | 3% | 3% | | | | | 1% |
| Properties | | | | | | | | | | | |
| appearance | | grayish white grease | grayish white grease | grayish white grease | grayish white grease | grayish white grease | brownish grease | reddish brown grease | blackish brown grease | blackish brown grease | grayish white fluid (separation of powder) |
| consistency (25° C.) | 0 W | 315 | 324 | 260 | 242 | 290 | 320 | 328 | 315 | 320 | measurement impossible |
| | 60 W | 320 | 339 | 267 | 247 | 292 | 315 | 320 | 320 | 325 | |
| dropping point °C. | | 205 | 177 | 195 | 215 | 160 | no drop | 198 | 198 | 197 | |
| Lubricity | | | | | | | | | | | |
| Extreme pressure test (Falex method) (according to ASTM D2625B) | | 1750 | 2000 | 1750 | 1750 | 1500 | 1000 | 750 | 1500 | 300 | 1750 |
| Seizuring load (pound) | | | | | | | | | | | |
| SRV oscillating friction and wear test | friction coefficient | 0.092 | 0.092 | 0.093 | 0.090 | 0.095 | 0.093 | 0.090 | 0.135 | 0.105 (0.35) | 0.105 |
| | worn depth μm | 0.3 | 0.2 | 0.3 | 0.2 | 0.4 | 0.6 | 0.4 | 1.6 | 4.8 | 0.2 |

TABLE 2

| host | guest | Example 16 | Example 17 | Example 18 | Example 19 | Example 20 | Example 21 | Comparative Example 6 | Comparative Example 7 | Comparative Example 8 | Comparative Example 9 |
|---|---|---|---|---|---|---|---|---|---|---|---|
| Intercalation compound | | | | | | | | | | | |
| $ZnPS_3$ | octylamine | 20% | 20% | 20% | | | | | | | |
| $ZnPS_3$ | octadecyl-amine | | | | 20% | 20% | 20% | | | | |
| D O S | | 78% | | | 78% | | | 80% | 77% | | |
| Base oil | | | | | | | | | | | |
| poly α-olefin oil (viscosity 100° C., 40.7 cSt) | | | 78% | | | 78% | | | | 80% | |
| alkyldiphenyl ether oil (viscosity 100° C., 17.2 cSt) | | | | 78% | | | 78% | | | | 80% |
| Dispersant | | | | | | | | | | | |
| acetone | | 2% | 2% | 2% | 2% | 2% | 2% | | | | |
| Thickener | | | | | | | | | | | |
| lithium stearate | | | | | | | | 20% | 20% | 20% | 20% |
| Solid lubricant | | | | | | | | | | | |
| molybdenum disulfide | | | | | | | | | 3% | | |
| Properties | | | | | | | | | | | |
| appearance | | grayish white grease | grayish white grease | grayish white grease | grayish white grease | grayish white grease | grayish white grease | white grease | grayish black grease | white grease | white grease |
| consistency (25° C.) | 0 W | 295 | 304 | 312 | 282 | 290 | 308 | 270 | 268 | 272 | 304 |
| | 60 W | 297 | 310 | 315 | 290 | 290 | 308 | 274 | 270 | 280 | 291 |
| dropping point °C. | | 213 | 210 | 208 | 220 | 220 | 218 | 190 | 190 | 192 | 197 |
| Lubricity | | | | | | | | | | | |
| Extreme pressure test (Falex method) (according to ASTM D2625B) | | 1750 | 2000 | 1750 | 2000 | 2000 | 1750 | 750 | 1500 | 750 | 750 |
| Zeisuring load (pound) | | | | | | | | | | | |
| SRV oscillating friction and wear test | friction coefficient | 0.089 | 0.090 | 0.090 | 0.089 | 0.089 | 0.090 | 0.100 | 0.100 | 0.105 | 0.103 |
| | worn depth | 0.3 | 0.4 | 0.40 | 0.4 | 0.4 | 0.4 | 1.10 | 1.3 | 1.6 | 1.4 |

TABLE 2-continued

| host | guest | Example 16 | Example 17 | Example 18 | Example 19 | Example 20 | Example 21 | Comparative Example 6 | Comparative Example 7 | Comparative Example 8 | Comparative Example 9 |
|---|---|---|---|---|---|---|---|---|---|---|---|
| | μm | | | | | | | | | | |

III. Comparison of effects

III. 1 Examples in Table 1

Each of Examples 1 to 12 is a grease comprising the petroleum lubricating oil (ISO-VG 450) as a base oil and the intercalation compound as a thickener. Although there is a difference in the thickening effect in accordance with the kind of the amine compound intercalated between the host layers, as the amount of the intercalation compound added increases, the consistency of the grease becomes small. In any case, homogeneous greases of from No. 0 grade to No. 2 grade are obtained in these examples.

Each of Examples 13 to 15 is a grease containing a mixture of two intercalation compounds. In these examples, a grease of No. 2 grade is obtained by using 30% by weight in total of the intercalation compounds as a thickener.

As compared with commercially available greases of Comparative Examples 1 and 2, all of the greases according to the invention are excellent in the extreme pressure property and the wear resistance. Particularly, they exhibit an extreme pressure property higher than that of the commercially available grease containing an extreme pressure additive. Furthermore, the dropping point higher than that of the commercially available lithium soap-base grease is obtained when the kind of the guest is properly selected. In the latter case, the resulting grease can be used as a heat-resistant grease.

Comparative Examples 3 and 4 are greases obtained by adding molybdenum disulfide and graphite to the commercially available lithium soap-base grease, respectively, but the wear resistance is considerably poor as compared with the greases according to the invention. Moreover, molybdenum disulfide and graphite are substances having a layered crystal structure similar to that of the intercalation compound and are added as a solid lubricant to the grease. However, these compounds have no effect of thickening the lubricating oil, so that they are merely used as a lubricant in the grease or lubricating oil. That is, they do not develop both effects as an extreme pressure additive and a solid lubricant different from the intercalation compound according to the invention used as a thickener.

Comparative Example 5 is a solid lubricant described in U.S. Pat. No. 4,130,492 comprising a metallic phosphorus chalcogenide. However, this compound is not an intercalation compound, so that it has no thickening effect.

The intercalation compounds according to the invention are high in the seizuring load and excellent in the extreme pressure property, and also excellent in the wear resistance as seen from the data of Table 1. This is based on an effect of a pyrophosphate produced by decomposition of phosphorus chalcogenide, which is considered that the pyrophosphate forms a lubricating film on the surface of iron to decrease friction. Such an effect is a phenomenon first achieved when the metal in the metallic chalcogenide is phosphorus and can not be anticipated when the chalcogenide compound contains a metal other than phosphorus.

III.2 Examples in Table 2

Examples 16 to 18 are greases obtained by mixing and kneading 20% by weight of the intercalation compound consisting of $ZnPS_3$ as a host and octylamine as a guest with various commercially available synthetic lubricating oils and adding acetone as a thickener thereto, respectively. In this case, DOS is used as an ester series synthetic oil, and poly α-olefin oil is used as a hydrocarbon synthetic oil, and alkyldiphenyl ether oil is used as an ether series synthetic oil.

Examples 19 to 21 are greases obtained from the intercalation compound consisting of $ZnPS_3$ as a host and octadecylamine as a guest in the same manner as in Examples 16 to 18, respectively.

Comparative Examples 6 to 9 are a lithium soap-base grease and greases obtained by mixing with the above synthetic lubricating oils, respectively.

The greases of Examples are considerably excellent in the extreme pressure property and wear resistance as compared with the greases of Comparative Examples.

Even in case of using the synthetic lubricating oil, the intercalation compounds according to the invention simultaneously develop the thickening action and actions as an extreme pressure additive and a solid lubricant.

What is claimed is:

1. A grease composition consisting essentially of a base oil and 1–70% by weight of at least one intercalation compound consisting of a metallic phosphorus chalcogenide as a host layer and an alkylamine or alkylammonium chloride as a guest.

2. A grease composition according to claim 1, wherein said metallic phosphorus chalcogenide has a molecular formula of $MPX_3$, wherein M is a metal element selected from Zn, Mg, Ca, V, Mn, Fe, Co, Ni, Pb, Cd, Hg, Sn and Nb and X is a chalcogen element selected from S, Se and Te.

3. A grease composition according to claim 2, wherein said metallic phosphorus chalcogenide is $ZnPS_3$, $ZnPSe_3$, $ZnPTe_3$, $NiPS_3$, $FePS_3$, $FePSe_3$, $MnPS_3$, $MnPSe_3$, $MgPS_3$, $MgPSe_3$, $CaPS_3$ or $CaPSe_3$.

4. A grease composition according to claim 1, wherein said guest is alkylamine and has the following molecular formula:

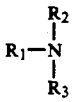

wherein each of $R_1$, $R_2$ and $R_3$ is a hydrogen atom or a straight or branched chain alkyl group having a carbon number of 1–24.

5. A grease composition according to claim 4, wherein said alkylamine is selected from n-butylamine, octylamine, 2-octylamine, dodecylamine, hexadecylamine, octadecylamine, oleylamine, N-methyl octadecylamine, and N,N-dimethyl octadecylamine.

6. A grease composition according to claim 1, wherein said guest is alkylammonium chloride and has the following molecular formula:

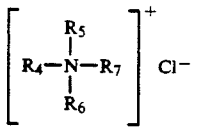

wherein two of $R_4$, $R_5$, $R_6$ and $R_7$ are methyl group or a straight or branched chain alkyl group having a carbon number of 4–24, respectively, and the remaining two are methyl group, respectively.

7. A grease composition according to claim 6, wherein said alkylammonium chloride is selected from trimethylhexadecyl ammonium chloride, trimethyloctadecyl ammonium chloride, and dimethyldioctadecyl ammonium chloride.

8. A grease composition according to claim 1, wherein said base oil is selected from petroleum lubricating oil and synthetic lubricating oils.

9. A grease composition according to claim 8, wherein said base oil is a synthetic lubricating oil and is selected from ester oil, polyether oil, polyolefin oil, polyglycol oil and silicone oil.

* * * * *